US010030295B1

(12) United States Patent
Bryant et al.

(10) Patent No.: US 10,030,295 B1
(45) Date of Patent: Jul. 24, 2018

(54) 6XXX ALUMINUM ALLOY SHEET PRODUCTS AND METHODS FOR MAKING THE SAME

(71) Applicant: ARCONIC INC., Pittsburgh, PA (US)

(72) Inventors: James Daniel Bryant, Murrysville, PA (US); Colleen Elizabeth Weller, Waterford, MI (US); Cyril F. Bell, II, Louisville, TN (US); Barbara Lucille Hyde, Tellico Plains, TN (US); Dirk C. Mooy, Bettendorf, IA (US)

(73) Assignee: Arconic Inc., Pittsburgh, PA (US)

( * ) Notice: Subject to any disclaimer, the term of this patent is extended or adjusted under 35 U.S.C. 154(b) by 0 days.

(21) Appl. No.: 15/680,051

(22) Filed: Aug. 17, 2017

Related U.S. Application Data

(60) Provisional application No. 62/526,950, filed on Jun. 29, 2017.

(51) Int. Cl.

| | |
|---|---|
| ***C22F 1/047*** | (2006.01) |
| ***C22F 1/043*** | (2006.01) |
| ***C22C 21/02*** | (2006.01) |
| ***C22C 21/08*** | (2006.01) |

(52) U.S. Cl.
CPC ..... *C22F 1/047* (2013.01); *C22C 21/02* (2013.01); *C22C 21/08* (2013.01); *C22F 1/043* (2013.01)

(58) Field of Classification Search
CPC ..... C22F 1/043
See application file for complete search history.

(56) References Cited

U.S. PATENT DOCUMENTS

| | | | |
|---|---|---|---|
| 4,174,232 | A | 11/1979 | Lenz et al. |
| 4,502,900 | A | 3/1985 | Althoff |
| 4,699,673 | A | 10/1987 | Kobayashi et al. |
| 4,808,247 | A | 2/1989 | Komatsubara et al. |
| 4,927,470 | A | 5/1990 | Cho |
| 4,929,285 | A | 5/1990 | Zaidi |
| 4,946,517 | A | 8/1990 | Cho |
| 5,266,130 | A | 11/1993 | Uchida et al. |
| 5,480,498 | A | 1/1996 | Beaudoin et al. |
| 5,514,228 | A | 5/1996 | Wyatt-Mair et al. |
| 5,718,780 | A | 2/1998 | Bryant et al. |
| 5,766,546 | A | 6/1998 | Schwellinger |
| 5,810,949 | A | 9/1998 | Chakrabarti et al. |
| 5,858,134 | A | 1/1999 | Beehet et al. |
| 6,110,297 | A | 8/2000 | Hayashi et al. |
| 6,120,623 | A | 9/2000 | Gupta et al. |
| 6,193,818 | B1 | 2/2001 | Legresy et al. |
| 6,280,543 | B1 | 8/2001 | Zonker et al. |
| 6,334,916 | B1 | 1/2002 | Matsumoto et al. |
| 6,344,096 | B1 | 2/2002 | Baumann et al. |
| 6,391,127 | B1 | 5/2002 | Wyatt-Mair et al. |
| 6,406,571 | B1 | 6/2002 | Gupta et al. |
| 6,423,164 | B1 | 7/2002 | Bryant et al. |
| 6,464,805 | B2 | 10/2002 | Matsuda et al. |
| 6,652,678 | B1 | 11/2003 | Marshall et al. |
| 6,743,309 | B2 | 6/2004 | Bryant |
| 6,780,259 | B2 | 8/2004 | Bull et al. |
| 6,863,747 | B2 | 3/2005 | Kashiwazaki et al. |
| 6,911,099 | B2 | 6/2005 | Magnusen et al. |
| 6,994,760 | B2 | 2/2006 | Benedictus et al. |
| 7,029,543 | B2 | 4/2006 | Bull et al. |
| 7,182,825 | B2 | 2/2007 | Unal et al. |
| 7,189,294 | B2 | 3/2007 | Kimura et al. |
| 7,824,607 | B2 | 11/2010 | Kajihara et al. |
| 8,163,113 | B2 | 4/2012 | Mishra et al. |
| 8,303,736 | B2 | 11/2012 | Matsuoka |
| 8,328,963 | B2 | 12/2012 | Takaki et al. |
| 8,366,846 | B2 | 2/2013 | Takai et al. |
| 8,578,747 | B2 | 11/2013 | Li et al. |
| 8,663,405 | B2 | 3/2014 | Krajewski |
| 8,691,031 | B2 | 4/2014 | Zhao et al. |
| 8,999,079 | B2 | 4/2015 | Kamat et al. |
| 9,067,251 | B2 | 6/2015 | Carter et al. |
| 9,085,328 | B2 | 7/2015 | Bassi et al. |
| 9,090,950 | B2 | 7/2015 | Hales et al. |
| 9,249,483 | B2 | 2/2016 | Bakai et al. |
| 9,297,394 | B2 | 3/2016 | Li et al. |
| 9,359,660 | B2 | 6/2016 | Kamat et al. |
| 9,399,808 | B2 | 7/2016 | Matsumoto et al. |
| 9,453,273 | B2 | 9/2016 | Matsumoto et al. |
| 9,669,604 | B2 | 6/2017 | Tatsumi et al. |
| 9,718,145 | B2 | 8/2017 | Itoh et al. |
| 2004/0094249 | A1 | 5/2004 | Uchida et al. |
| 2008/0011816 | A1 | 1/2008 | Kilmer |
| 2014/0190595 | A1 | 7/2014 | Kehl et al. |
| 2015/0354044 | A1 | 12/2015 | Shishido et al. |
| 2016/0201158 | A1 | 7/2016 | Kamat et al. |
| 2016/0348225 | A1 | 12/2016 | Bryant et al. |
| 2017/0114431 | A1 | 4/2017 | Aruga et al. |

FOREIGN PATENT DOCUMENTS

| | | |
|---|---|---|
| WO | WO2016/190408 | 12/2016 |
| WO | WO2016/193640 | 12/2016 |

OTHER PUBLICATIONS

Inaba, Takashi, "Automobile Aluminum Sheet", Chapter 2 of *Automotive Engineering: Lightweight, Functional, and Novel Materials*, Ed. Cantor, Brian, CRC Press, Boca Raton, FL, 2008.

American National Standard Alloy and Temper Designation Systems for Aluminum, The Aluminum Association, Inc., ANSI H35.1M, pp. 1-11, 2009.

Registration Record Series Teal Sheets, International Alloy Designations and Chemical Composition Limits for Wrought Aluminum and Wrought Aluminum Alloys, 2015, pp. 1-31.

*Primary Examiner* — Jessee Roe
(74) *Attorney, Agent, or Firm* — Greenberg Traurig, LLp

(57) ABSTRACT

The present disclosure relates to methods for producing new 6xxx aluminum alloy sheet products having tailored precipitate phase particle size distributions. The tailored precipitate phase particle size distributions may be produced by preparing a 6xxx aluminum alloy sheet for precipitate phase modification, and then modifying an initial precipitate phase particle size distribution of the material. The modifying may include heating the intermediate gauge strip to a temperature of from 440° C. (825° F.) to 500° C. (932° F.) and for a time sufficient to create a modified strip product having a modified (tailored) precipitate phase particle size distribution. The modified strip product may realize improved properties.

14 Claims, 22 Drawing Sheets

Alloy 1 – As-hot rolled

Alloy 1 — As-annealed

Alloy 1 – As-cold rolled

Alloy 2 – As-cold rolled

Alloy 2 – T4 temper

| Mg2Si Particle Distribution Statistic | As-cold rolled | | | T4 Temper | | |
|---|---|---|---|---|---|---|
| | Alloy 1 (Inv.) | Alloy 2 (Non-inv.) | Delta (Alloy 1 - Alloy 2) | Alloy 1 (Inv.) | Alloy 2 (Non-inv.) | Delta (Alloy 1 - Alloy 2) |
| Total Area Fraction of All Mg2Si Particles (%) | 0.98 | 1.26 | -0.28 | 0.13 | 0.13 | 0.00 |
| Area Fraction of Fine Mg2Si (%) | 0.36 | 0.97 | -0.61 | 0.02 | 0.10 | -0.08 |
| Area Fraction of Coarse Mg2Si Particles (%) | 0.62 | 0.32 | 0.30 | 0.11 | 0.03 | 0.08 |
| Proportion of Coarse Mg2Si particles (%) | 63% | 25% | 38% | 85% | 23% | 62% |
| | | | | | | |
| Mean Mg2Si particle Diameter (micron) | 0.60 | 0.40 | 0.20 | 0.98 | 0.40 | 0.58 |
| $Log_{10}$(Standard Deviation of Diameter) | 0.21 | 0.20 | 0.01 | 0.29 | 0.33 | -0.04 |

FIG. 10

| Rating | Condition | Description | Example Image |
|---|---|---|---|
| 1 | Good | Mild to moderate orange peel | 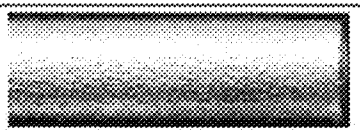 |
| 2 | Acceptable | Moderate to heavy orange peel | 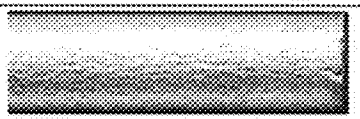 |
| 3 | Bad | Cracks visible with 3x magnification | 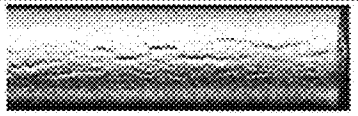 |
| 4 | Fail | Cracks visible to naked eye | 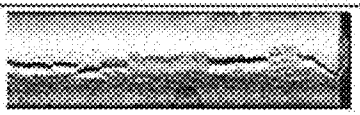 |
| 5 | Fail | Fracture/continuous crack along the bend line | 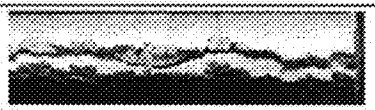 |
FIG. 13

6XXX ALUMINUM ALLOY SHEET PRODUCTS AND METHODS FOR MAKING THE SAME

CROSS-REFERENCE TO RELATED APPLICATION

This patent application claims benefit of priority of U.S. Provisional Patent Application No. 62/526,950, filed Jun. 29, 2017, entitled "6XXX ALUMINUM ALLOY SHEET PRODUCTS AND METHODS FOR MAKING THE SAME", which is incorporated herein by reference in its entirety.

BACKGROUND

Aluminum alloys are useful in a variety of applications. For example, 6xxx aluminum alloys have Mg and Si as the principle alloying elements, other than aluminum. 6xxx aluminum alloy products are known to have good strength and corrosion resistance properties. However, improving one property of an aluminum alloy without degrading another property is elusive. For example, it is difficult to increase the strength of a 6xxx aluminum alloy without decreasing its corrosion resistance.

SUMMARY OF THE INVENTION

Broadly, the present disclosure relates to 6xxx aluminum alloy sheet products and methods for making the same. Generally, the new 6xxx aluminum alloy sheet products realize improved hemming response and/or decreased natural aging rate. The new 6xxx aluminum alloy sheet products may realize the improved properties by employing controlled, post-hot rolling conditions, thereby realizing a modified precipitate phase particle size distribution within the alloy. The modified precipitate phase particle size distribution generally realizes an increased proportion of coarse particles (2-D sectional diameter ≥0.5 micron), which are more resistant to dissolution during solution heat treatment. Correspondingly, the modified precipitate phase particle size distribution generally realizes a lower proportion of fine particles, which may dissolve during solution heat treatment. Thus, following solution heat treatment, the new 6xxx aluminum alloys have an increased proportion of coarse particles, resulting in a decreased rate of natural aging, and/or improved hemming response.

Referring now to FIG. 1, one embodiment of making the new 6xxx aluminum alloy sheet products (100) includes preparing a 6xxx aluminum alloy for precipitate phase modification (110), modifying (120) the precipitate phase particle size distribution within the alloy, and then performing post-modification steps (130), as described below.

The preparing (110) may include, and now referring to FIG. 2, casting the 6xxx aluminum alloy as ingot (111), scalping (112) and/or homogenizing (113), and then hot rolling (114). The new 6xxx aluminum alloy sheet products may realize, due to the preparing (110), an initial distribution of precipitate phase particles (115), which includes fine and coarse precipitate phase particles. The area fraction of coarse precipitate phase particles plus the area fraction of fine precipitate phase particles make-up the total area fraction of precipitate phase particles.

As used herein, "precipitate phase particles" means the equilibrium phase particles of the meta-stable phase of a 6xxx aluminum alloy, such as $Mg_2Si$ (beta phase) particles and $Al_5Cu_2Mg_8Si_6$ (Q phase) particles, among others.

As used herein, "fine precipitate phase particles" means precipitate phase particles having a mean sectional diameter in a 2-dimensional image of less than 0.50 microns (116). As used herein, "coarse precipitate phase particles" means precipitate phase particles having a mean sectional diameter in a 2-dimensional image of at least 0.50 microns (117).

As used herein, "mean sectional diameter" means the mean sectional diameter as determined by analyzing a minimum of ten (10), two-dimensional image micrographs at 1000× magnification, using a scanning electron microscope (SEM) operating in backscattered electron imaging (BEI) mode, with sampling taken at both T/4 locations (top, bottom) in the L-ST plane.

The casting step (111) may include, semi-continuous casting (e.g., direct chill casting), or continuous casting (e.g., via twin belt casting or twin roll casting), among other methods. The casting (111) may realize a 6xxx aluminum alloy ingot suitable for further processing to 6xxx aluminum alloy sheet products.

The 6xxx aluminum alloy ingot may, due to the casting (111), have surface defects (e.g., non-uniform surface layers). Scalping (112) may be employed to condition the surface of the 6xxx aluminum alloy ingot. For example, scalping (112) may be employed to remove the surface defects, prior to any further processing. The scalping (112) may include machining off a surface layer along the rolling faces of the 6xxx aluminum alloy ingot after it has solidified.

The 6xxx aluminum alloy ingot may, due to the casting (111), have an inhomogeneous distribution of elements. The homogenizing (113) may include thermally treating the 6xxx aluminum alloy ingot, thereby dissolving at least some of the elements of the precipitate phase into the aluminum matrix, and then cooling (e.g., air cooling), thereby modifying the microstructure of the ingot. The homogenizing (113) may include heating the 6xxx aluminum alloy ingot to a temperature below the solidus of the 6xxx aluminum alloy.

Following casting (111), and any other preparation (110) steps, the 6xxx aluminum alloy ingot may be hot rolled (114). The hot rolling (114) may include hot rolling the 6xxx aluminum alloy ingot to an intermediate gauge strip. As mentioned above, the hot rolled product will have an initial distribution of precipitate phase particles.

Referring now to FIG. 3, the modifying step (120) may include heating the hot rolled/intermediate gauge 6xxx aluminum alloy to a temperature sufficient, and for a period of time sufficient to create a modified 6xxx aluminum alloy strip product having a modified precipitate phase particle size distribution. The modified precipitate phase particle size distribution comprises a modified amount of coarse and fine precipitate phase particles. Thus, the modified precipitate phase particle size distribution comprises a modified area fraction of coarse precipitate phase particles plus a modified area fraction of fine precipitate phase particles, which makes-up a modified total area fraction of precipitate phase particles. The modified total area fraction of precipitate phase particles is generally at least double that of the initial total area fraction of precipitate phase particles (121).

Generally, the modifying (120) may include an anneal-like treatment, where the hot rolled/intermediate gauge 6xxx aluminum alloy strip is heated to an elevated temperature, such as a temperature of from 440-500° C. (122). In one embodiment, the modifying (120) includes heating the 6xxx aluminum alloy strip product to a temperature of at least 445° C. In another embodiment, the modifying (120) includes heating the 6xxx aluminum alloy strip product to a temperature of at least 450° C. In one embodiment, the modifying (120) includes heating the 6xxx aluminum alloy strip product to a temperature of not greater than 495° C. In another embodiment, the modifying (120) includes heating the 6xxx aluminum alloy strip product to a temperature of not greater than 490° C. In yet another embodiment, the modifying (120) includes heating the 6xxx aluminum alloy strip product to a temperature not greater than 485° C. In another embodiment, the modifying (120) includes heating the 6xxx aluminum alloy strip product to a temperature not greater than 480° C. In yet another embodiment, the modifying (120) includes heating the 6xxx aluminum alloy strip product to a temperature not greater than 475° C. In another embodiment, the modifying (120) includes heating the 6xxx aluminum alloy strip product to a temperature not greater than 470° C. In one embodiment, the modifying (120) includes heating the 6xxx aluminum alloy strip product to a temperature of from 450-470° C.

The modifying step (120) generally includes heating the 6xxx aluminum alloy strip product to a temperature sufficient and for a time sufficient to create a modified precipitate phase particle size distribution, wherein the modified total area fraction of precipitate phase particles is generally at least double that of the initial total area fraction of precipitate phase particles, such as by heating for a period of time of from 0.5 to 8 hours (124). In one embodiment, the modifying (120) includes heating the 6xxx aluminum alloy strip product to a temperature for a time of at least 0.75 hours. In another embodiment, the modifying (120) includes heating the 6xxx aluminum alloy strip product to a temperature for a time of at least 1.0 hours. In yet another embodiment, the modifying (120) includes heating the 6xxx aluminum alloy strip product to a temperature for a time of at least 1.5 hours. In another embodiment, the modifying (120) includes heating the 6xxx aluminum alloy strip product to a temperature for a time of at least 2.0 hours. In one embodiment, the modifying (120) includes heating the 6xxx aluminum alloy strip product for a time of not greater than 7.5 hours. In another embodiment, the modifying (120) includes heating the 6xxx aluminum alloy strip product for a time of not greater than 7.0 hours. In yet another embodiment, the modifying (120) includes heating the 6xxx aluminum alloy strip product for a time of not greater than 6.5 hours. In another embodiment, the modifying (120) includes heating the 6xxx aluminum alloy strip product for a time of not greater than 6.0 hours. In yet another embodiment, the modifying (120) includes heating the 6xxx aluminum alloy strip product for a time of not greater than 5.5 hours. In another embodiment, the modifying (120) includes heating the 6xxx aluminum alloy strip product for a time of not greater than 5.0 hours. In yet another embodiment, the modifying (120) includes heating the 6xxx aluminum alloy strip product for a time of not greater than 4.5 hours. In another embodiment, the modifying (120) includes heating the 6xxx aluminum alloy strip product for a time of not greater than 4.0 hours. In one embodiment, the modifying (120) includes heating the 6xxx aluminum alloy strip product to a temperature for a time of from 1 to 5 hours.

As noted above, due to the modifying step (120), the modified 6xxx aluminum alloy strip product realizes the modified precipitate phase particle size distribution. In one embodiment, the modified precipitate phase particle size distribution comprises at least 0.08% coarse particles by area (127). In another embodiment, the modified precipitate phase particle size distribution comprises at least 0.25% coarse particles by area. In yet another embodiment, the modified precipitate phase particle size distribution comprises at least 0.35% coarse particles by area. In another embodiment, the modified precipitate phase particle size distribution comprises at least 0.45% coarse particles by area.

As noted above, the modifying adjusts the amount of coarse and fine precipitate phase particles in the modified 6xxx aluminum alloy strip product. In one embodiment, at least a third (33%) of the precipitate phase particles of the modified 6xxx aluminum alloy strip product are coarse particles (126). In another embodiment, at least 38% of the precipitate phase particles are coarse particles. In yet another embodiment, at least 43% of the precipitate phase particles are coarse particles. In another embodiment, at least 47% of the precipitate phase particles are coarse particles. In yet another embodiment, at least 50% of the precipitate phase particles are coarse particles. In one embodiment, at least 5% of the precipitate phase particles are fine particles. In another embodiment, at least 15% of the precipitate phase particles are fine particles. In yet another embodiment, at least 25% of the precipitate phase particles are fine particles. In another embodiment, at least 35% of the precipitate phase particles are fine particles. In yet another embodiment, at least 45% of the precipitate phase particles are fine particles.

The modified precipitate phase particle size distribution may realize a mean 2-D sectional diameter of from 0.3 to 1.0 micron (129). In one embodiment, the modified precipitate phase particle size distribution realizes a mean 2-D sectional diameter of at least 0.35 micron. In another embodiment, the modified precipitate phase particle size distribution realizes a mean 2-D sectional diameter of at least 0.4 micron. In yet another embodiment, the modified precipitate phase particle size distribution realizes a mean 2-D sectional diameter of at least 0.45 micron. In another embodiment, the modified precipitate phase particle size distribution realizes a mean 2-D sectional diameter of at least 0.5 micron.

As noted above, the modifying step (120) is completed at a temperature sufficient and for a time sufficient to realize a modified precipitate phase particle distribution wherein the modified area fraction of coarse precipitate phase particles is at least double the initial area fraction of coarse precipitate phase particles. In one embodiment, the modified 6xxx aluminum alloy strip product realizes a modified precipitate phase particle size distribution wherein the modified area fraction of coarse precipitate phase particles is at least three times the initial area fraction of coarse precipitate phase particles. In another embodiment, the modified 6xxx aluminum alloy strip product realizes a modified precipitate phase particle size distribution wherein the modified area fraction of coarse precipitate phase particles is at least four times the initial area fraction of coarse precipitate phase particles. In another embodiment, the modified 6xxx aluminum alloy strip product realizes a modified precipitate phase particle size distribution wherein the modified area fraction of coarse precipitate phase particles is at least five times the initial area fraction of coarse precipitate phase particles. In another embodiment, the modified 6xxx aluminum alloy strip product realizes a modified precipitate phase particle size distribution wherein the modified area fraction of coarse precipitate phase particles is at least six times the initial area fraction of coarse precipitate phase particles. In another embodiment, the modified 6xxx aluminum alloy strip product realizes a modified precipitate phase particle size distribution wherein the modified area fraction of coarse precipitate phase particles is at least seven times the initial modified area fraction of coarse precipitate phase particles.

Referring now to FIG. 4, one embodiment of making the new 6xxx aluminum alloy sheet products is shown. The method includes post-modification steps (130), such as cold rolling (131) to final gauge, followed by solution heat treating (132), and optional post-quench thermal treatment (133) (e.g., pre-aging after quenching).

Generally, solution heat treatment includes heating the modified 6xxx aluminum alloy products to an elevated temperature, generally above the solvus temperature, for a time (e.g., soak time) sufficient to dissolve at least some of the precipitate phase particles. For the purposes of this disclosure, a solution heat treatment (132) step includes a quenching step after the solution heat treatment. The quenching may include cooling the 6xxx aluminum alloy by air cooling, or liquid cooling (e.g., water cooling), among other methods.

If employed, the post-quench thermal treatment step (133) may include heating the modified, solution heat treated 6xxx aluminum alloy sheet product to 50-100° C., immediately followed by air cooling. The post-quench thermal treatment step may be employed to modify the kinetics of strengthening precipitates during a subsequent aging step.

Referring now to FIGS. 4 and 5, following solution heat treatment (132), the modified 6xxx aluminum alloy sheet products may be further processed to one of a T4 or T6 temper (201), as defined by ANSI H35.1 (2009), thereby producing a tempered 6xxx aluminum alloy sheet product having a tempered precipitate phase particle size distribution. Prior to processing to a T4 or T6 temper, the 6xxx aluminum alloy sheet products may be flattened, straightened, or leveled by at least one of stretching or rolling. Processing to a T4 temper (136) may include naturally aging a modified, solution heat treated 6xxx aluminum alloy sheet product to a substantially stable condition. Processing to a T6 temper (137) may include artificially aging a modified, solution heat treated 6xxx aluminum alloy sheet product.

As used herein, a "T4 temper" means a 6xxx aluminum alloy sheet product that has been solution heat treated and naturally aged to a substantially stable condition and applies to 6xxx aluminum alloy sheet products that are not cold worked after solution heat treatment, or in which the effect of cold work in flattening or straightening (e.g., leveling) may not be recognized in mechanical property limits (ANSI H35.1(2009)).

As used herein, a "T6 temper" means a 6xxx aluminum alloy sheet product that has been solution heat treated and then artificially aged and applies to 6xxx aluminum alloy sheet products that are not cold worked after solution heat treatment, or in which the effect of cold work in flattening or straightening (e.g., leveling) may not be recognized in mechanical property limits (ANSI H35.1(2009)).

The tempered 6xxx aluminum alloy sheet products generally realize a tempered precipitate phase particle size distribution, where at least one-third (33%) of the precipitate phase particles are coarse particles (226), and at least 5% are fine particles (228). In one embodiment, at least 50% of the precipitate phase particles are coarse particles. In another embodiment, at least 60% of the precipitate phase particles are coarse particles. In yet another embodiment, at least 70% of the precipitate phase particles are coarse particles. In another embodiment, at least 80% of the precipitate phase particles are coarse particles. In one embodiment, at least 15% of the precipitate phase particles are fine particles. In another embodiment, at least 25% of the precipitate phase particles are fine particles. In yet another embodiment, at least 35% of the precipitate phase particles are fine particles. In another embodiment, at least 45% of the precipitate phase particles are fine particles.

In one embodiment, the tempered 6xxx aluminum alloy sheet product realizes a tempered precipitate phase particle size distribution wherein the tempered area fraction of coarse precipitate phase particles is at least the same as the initial area fraction of coarse precipitate phase particles. In another embodiment, the tempered 6xxx aluminum alloy sheet product realizes a tempered precipitate phase particle size distribution wherein the tempered area fraction of coarse precipitate phase particles is at least 1.1 the initial area fraction of coarse precipitate phase particles. In another embodiment, the tempered 6xxx aluminum alloy sheet product realizes a tempered precipitate phase particle size distribution wherein the tempered area fraction of coarse precipitate phase particles is at least 1.2 times the initial area fraction of coarse precipitate phase particles. In another embodiment, the tempered 6xxx aluminum alloy sheet product realizes a tempered precipitate phase particle size distribution wherein the tempered area fraction of coarse precipitate phase particles is at least 1.3 times the initial area fraction of coarse precipitate phase particles. In another embodiment, the tempered 6xxx aluminum alloy sheet product realizes a tempered precipitate phase particle size distribution wherein the tempered area fraction of coarse precipitate phase particles is at least 1.4 times the initial tempered area fraction of coarse precipitate phase particles. In yet another embodiment, the tempered 6xxx aluminum alloy sheet product realizes a tempered precipitate phase particle size distribution wherein the tempered area fraction of coarse precipitate phase particles is at least 1.5 times the initial tempered area fraction of coarse precipitate phase particles.

The tempered 6xxx aluminum alloy sheet products generally realize a tempered precipitate phase particle size distribution, wherein the tempered area fraction of coarse particles is at least 0.04% (227) by area. In one embodiment, the tempered area fraction of coarse particles is at least 0.06% by area. In another embodiment, the tempered area fraction of coarse particles is at least 0.08% by area. In yet another embodiment, the tempered area fraction of coarse particles is at least 0.10% by area.

The tempered precipitate phase particle size distribution may realize a mean 2-D sectional diameter of from 0.5 to 2.0 micron (229). In one embodiment, the tempered precipitate phase particle size distribution realizes a mean 2-D sectional diameter of at least 0.6 micron. In another embodiment, the tempered precipitate phase particle size distribution realizes a mean 2-D sectional diameter of at least 0.7 micron. In yet another embodiment, the tempered precipitate phase particle size distribution realizes a mean 2-D sectional diameter of at least 0.8 micron. In another embodiment, the tempered particle size distribution realizes a mean 2-D sectional diameter of at least 0.9 micron.

The 6xxx series aluminum alloys have magnesium (Mg) and silicon (Si) as the principle alloying elements, besides aluminum. For instance, the 6xxx aluminum alloy sheet products may be one of 6022, 6111, 6016, 6061, 6014, 6013, 6009, 6451, or 6010, as defined by the Aluminum Association Teal Sheets (2015), or one of their applicable equivalents. In one embodiment, the aluminum alloy is 6022. In another embodiment, the aluminum alloy is 6111.

The tempered 6xxx aluminum alloy sheet products may optionally be formed into a part (140). The part may be used in the automotive, rail, aerospace, or consumer electronic industries. For example, the tempered 6xxx aluminum alloy sheet products may be formed into an automotive part. Non-limiting examples of automotive parts may be automotive bodies or automotive panels. Non-limiting examples of automotive panels may be outer panels, inner panels for use in car doors, car hoods, or car trunks (deck lids), among others. One example of an automotive body product may be a structural component, which may be used in welding together sheet metal components of a car body (e.g., body-in-white). The utility of the new tempered 6xxx aluminum alloy sheet products is not limited to the personal automotive industry. For example, the new tempered 6xxx aluminum alloy sheet products may be used in other transportation marks such as light or heavy trucks. In addition to the transportation market uses described above, the new 6xxx aluminum alloy sheet products may be used in consumer electronics, such as, laptop computer cases, battery cases, among other stamped and formed products.

As described above, the new 6xxx aluminum alloy sheet products realize a decreased rate of natural aging. Generally, the rate of natural aging may be described by measuring a first tensile yield strength at 20 days of natural aging, a second tensile yield strength at 180 days of natural aging, and calculating the ratio of the second tensile yield strength to the first tensile yield strength. In one embodiment, the ratio of the second tensile yield strength to the first tensile yield strength is not greater than 1.25:1. In another embodiment, the ratio of the second tensile yield strength to the first tensile yield strength is not greater than 1.20:1. In another embodiment, the ratio of the second tensile yield strength to the first tensile yield strength is not greater than 1.15:1.

BRIEF DESCRIPTION OF THE DRAWINGS

FIG. 10 is a summary table of $Mg_2Si$ particle size distribution statistics of Alloy 1 and Alloy 2 of Example 1.

FIG. 13 is a hemming performance scale used by some automotive manufacturers.

DETAILED DESCRIPTION

Example 1

A first ingot of aluminum alloy 6022 was cast ("Alloy 1"). Alloy 1 was then scalped, homogenized, and then hot rolled to an intermediate gauge about of 5 mm (0.2 inch). Alloy 1 was then heated to an annealing temperature of 468° C. (875° F.) where it was held for 4 hours, and then air cooled to room temperature. The annealed intermediate gauge strip was then cold rolled to a final gauge about 1 mm (0.04 inch). The final gauge sheet was then solution heat treated, quenched, and then processed to a final gauge T4 sheet product. A second ingot of aluminum alloy 6022 was cast ("Alloy 2") and produced using the same steps and conditions as used for Alloy 1, except that Alloy 2 was heated to an annealing temperature of 427° C. (800° F.) where it was held for 4 hours, and then air cooled to room temperature.

Particle Size Distribution Analysis

Figure 1:
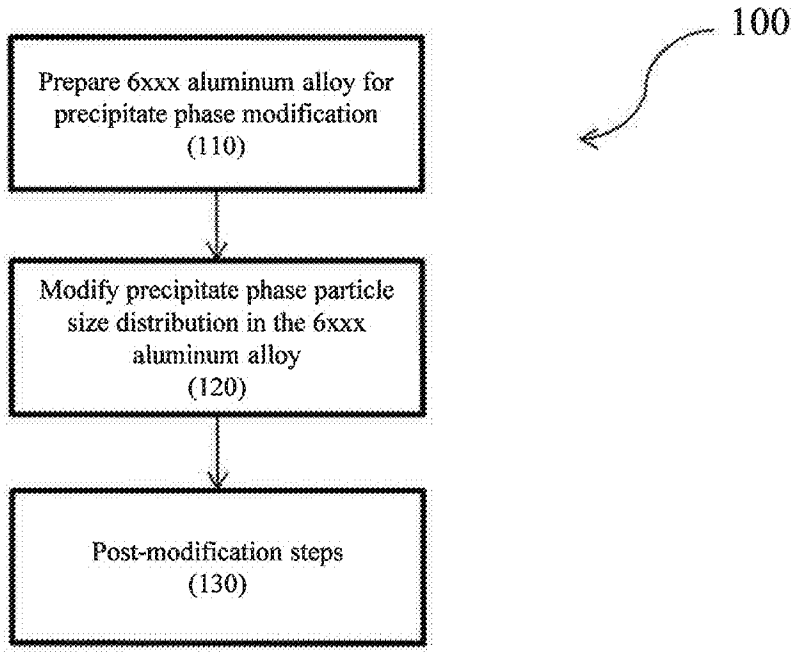
FIG. 1 is an embodiment of a method for producing 6xxx aluminum alloy sheet.
Figure 2:
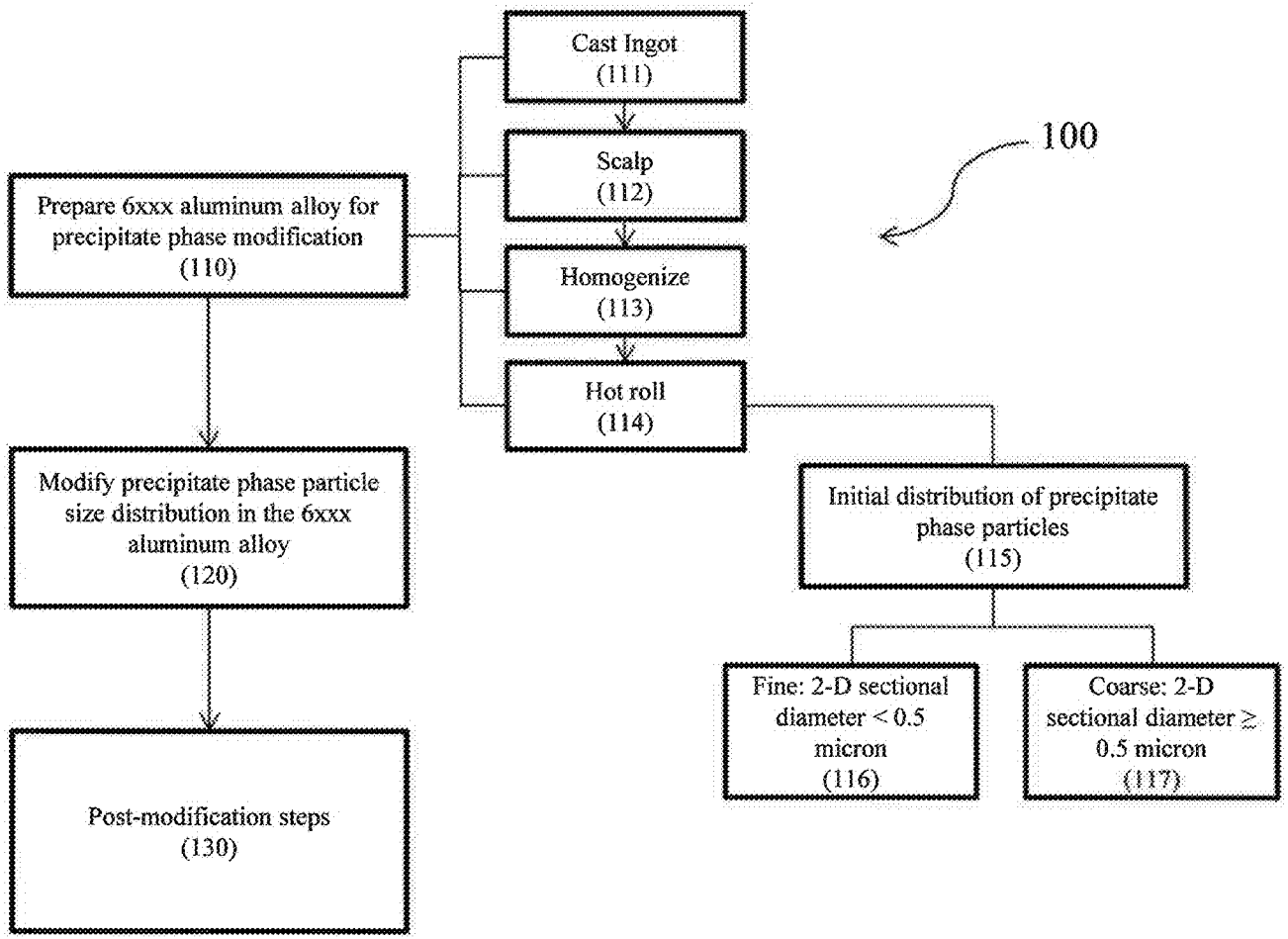
FIG. 2 is an embodiment of a method for producing 6xxx aluminum alloy sheet that illustrates the preparing step.
Figure 3:
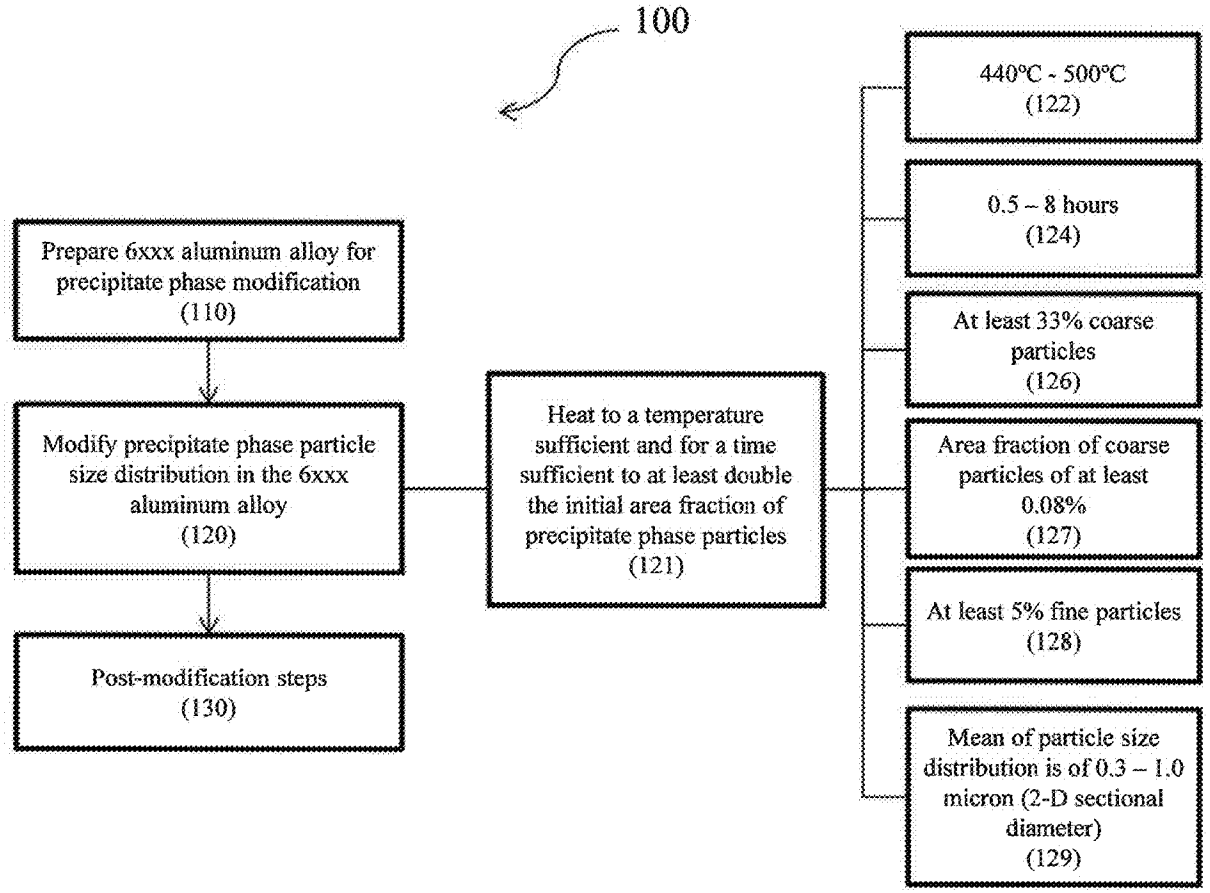
FIG. 3 is an embodiment of a method for producing 6xxx aluminum alloy sheet that illustrates the modifying step.
Figure 4:
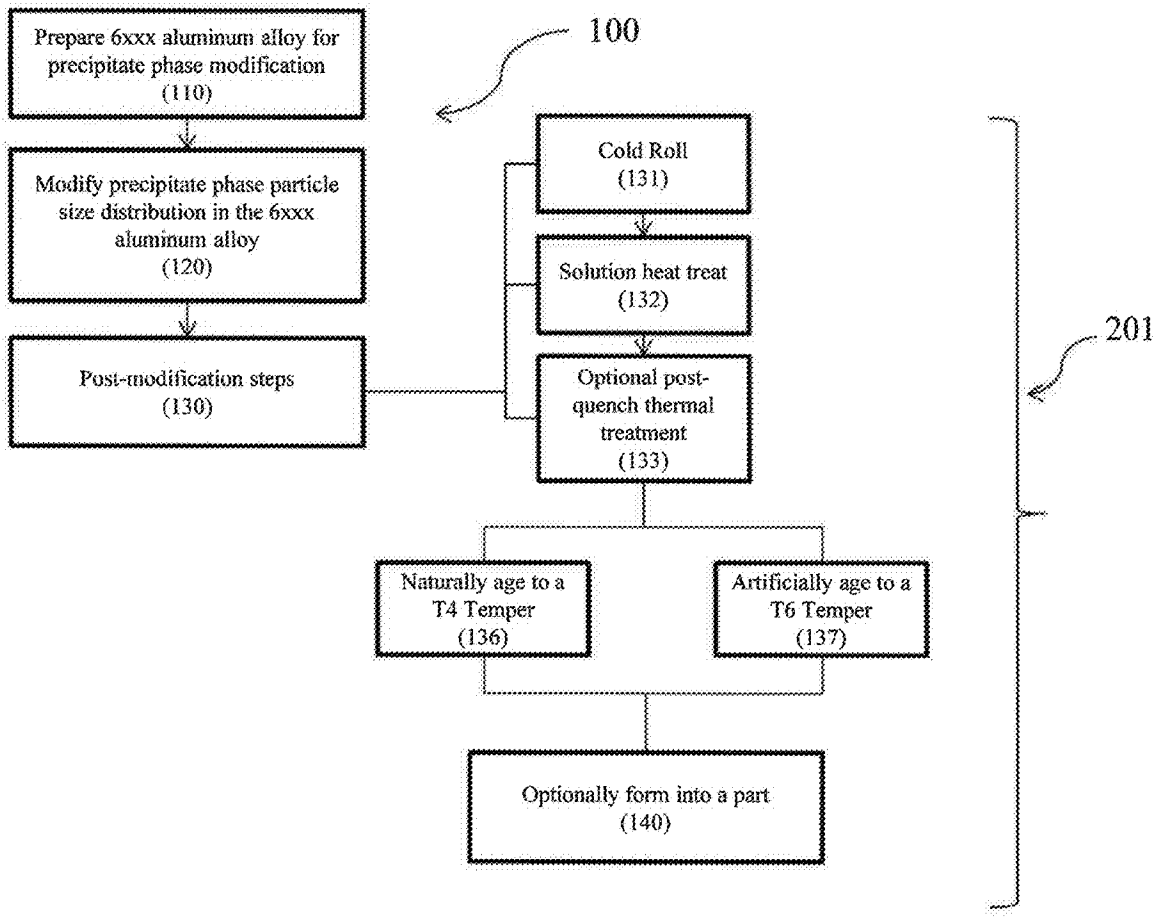
FIG. 4 is an embodiment of a method for producing 6xxx aluminum alloy sheet that illustrates the post-modification steps.
Figure 5:
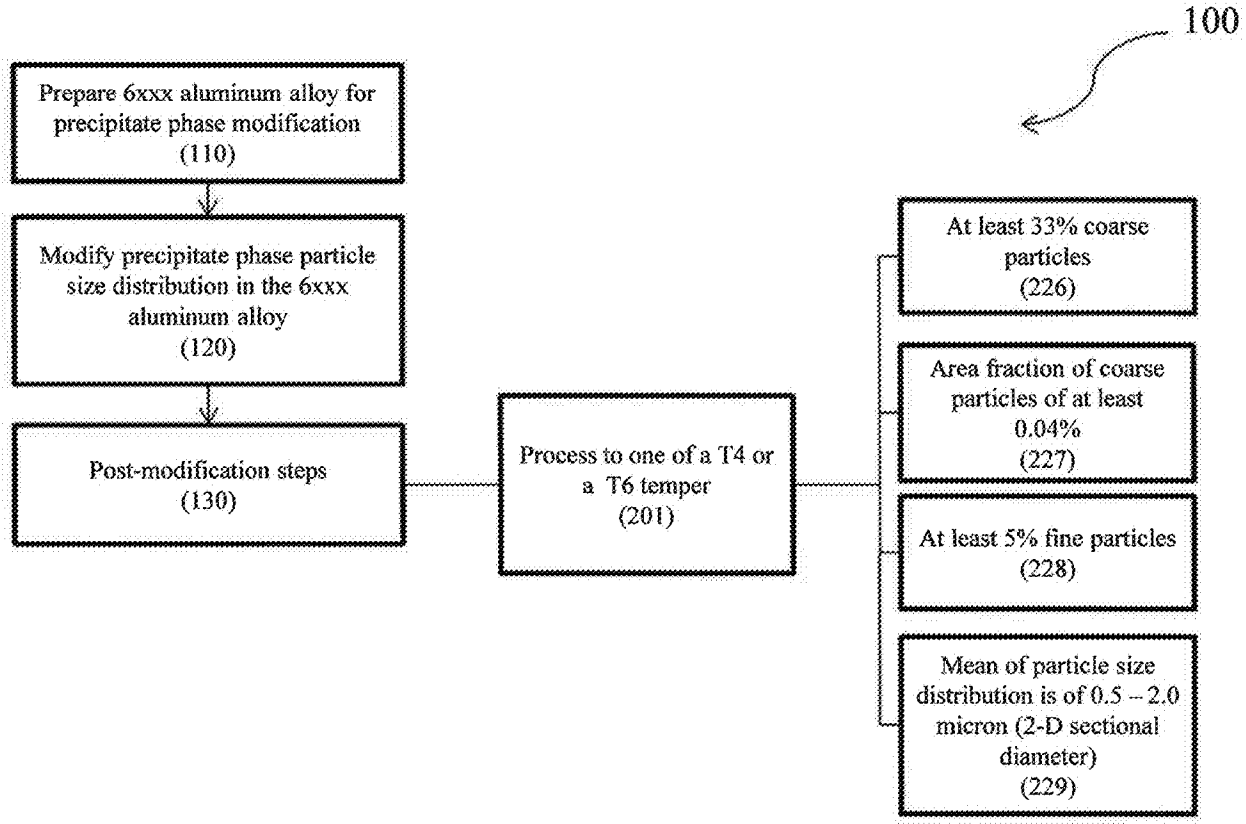
FIG. 5 is an embodiment of a method for producing 6xxx aluminum alloy sheet that further illustrates the post-modification steps.
Figure 6A:
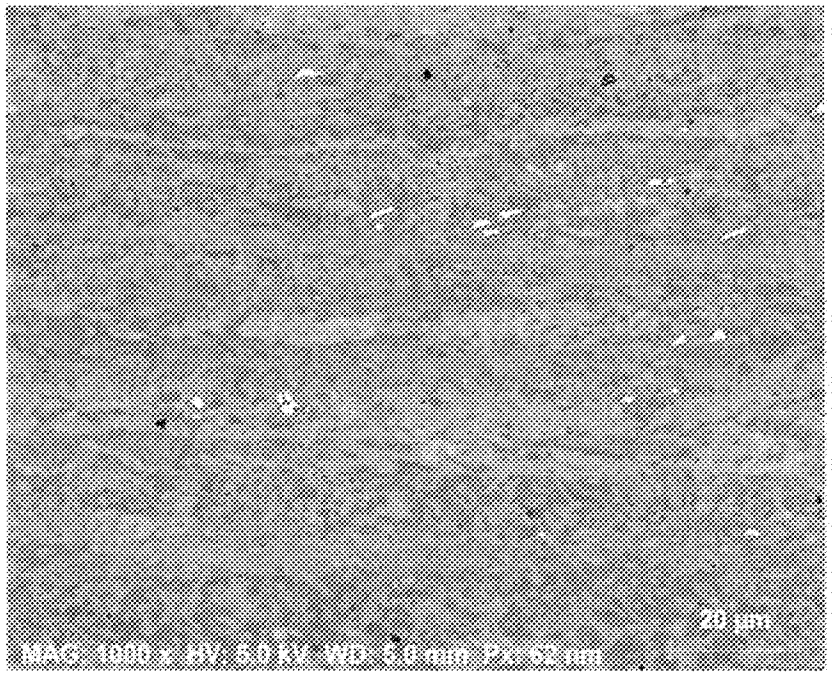
FIG. 6*a* is a micrograph of Alloy 1 of Example 1, in the as-hot rolled condition, taken in the L-ST plane at the T/4 location.
Figure 6B:
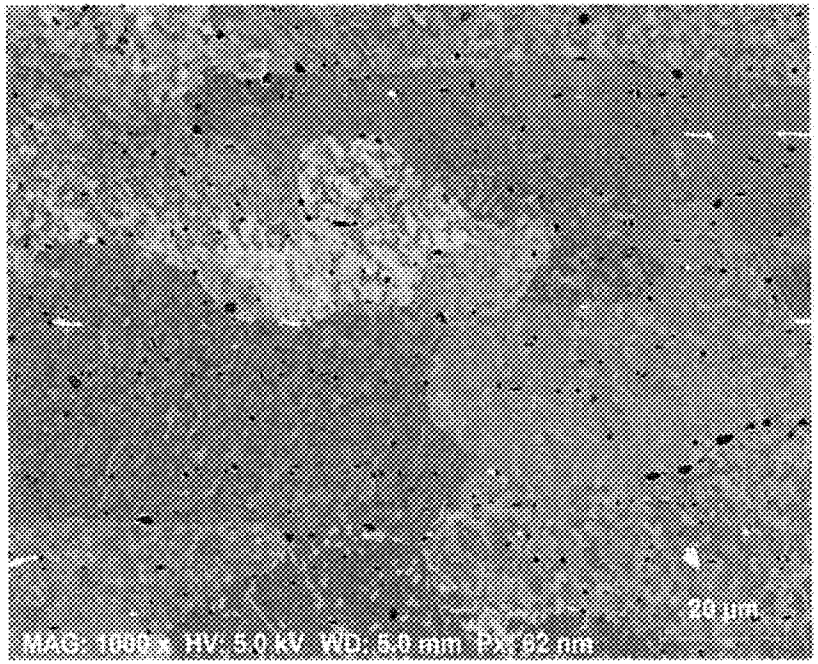
FIG. 6*b* is a micrograph of Alloy 1 of Example 1, in the as-annealed condition, taken in the L-ST plane at the T/4 location.
Figure 6C:
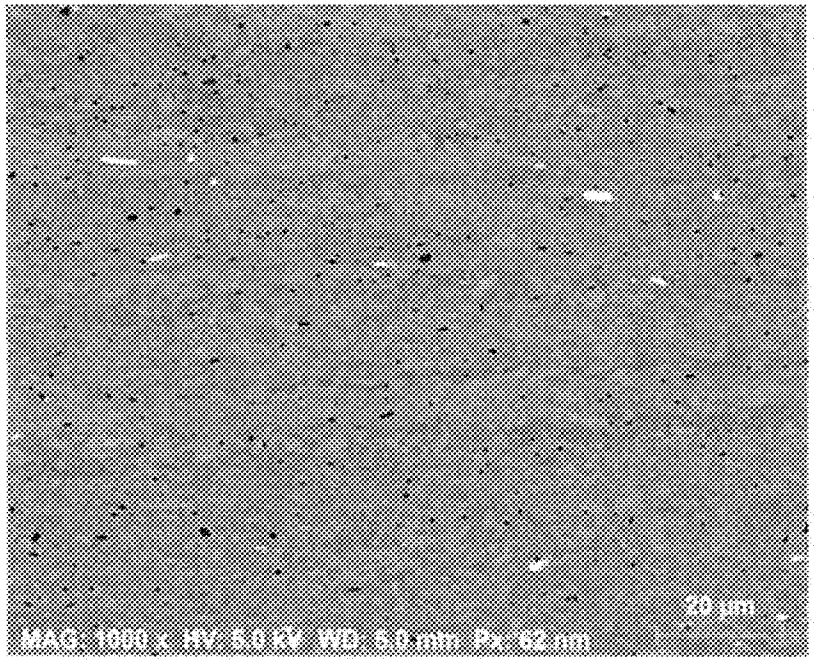
FIG. 6*c* is a micrograph of Alloy 1 of Example 1, in the as-cold rolled condition, taken in the L-ST plane at the T/4 location.
Figure 6D:
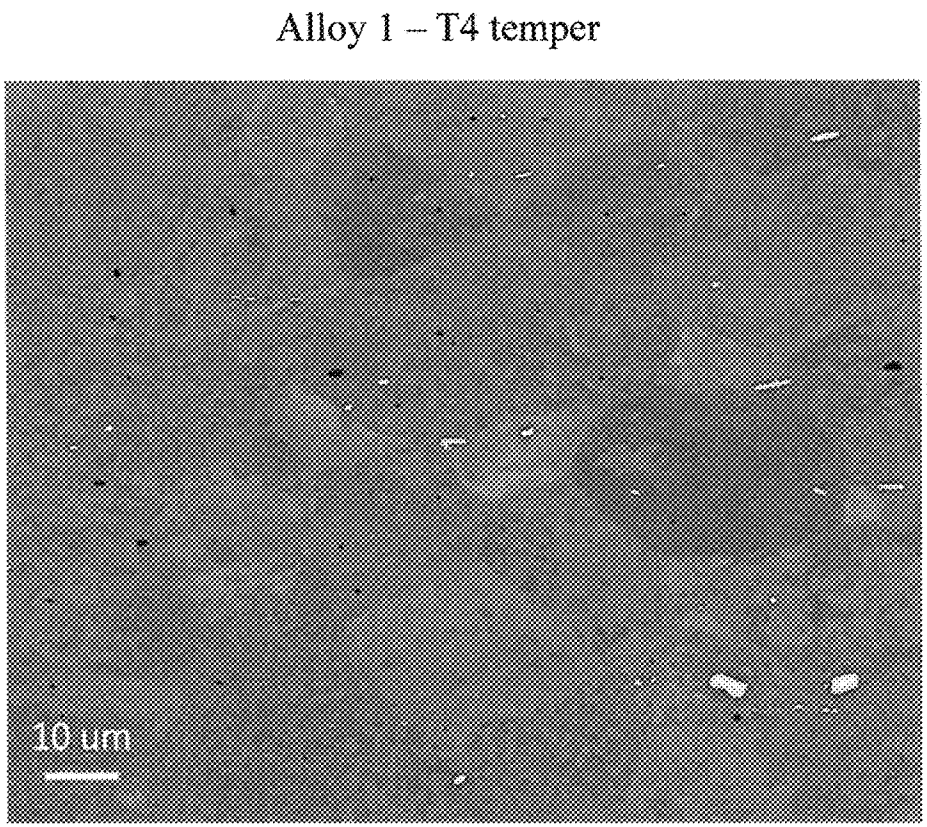
FIG. 6*d* is a micrograph of Alloy 1 of Example 1, in the T4 temper, taken in the L-ST plane at the T/4 location.
Figure 7A:
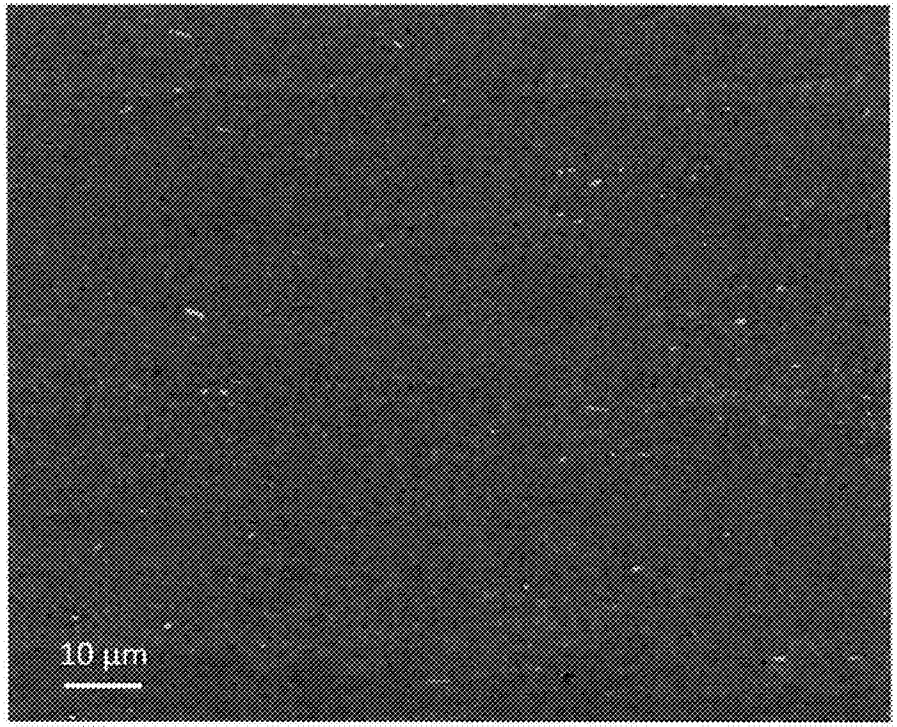
FIG. 7*a* is a micrograph of Alloy 2 of Example 1, in the as-cold rolled condition, taken in the L-ST plane at the T/4 location.
Figure 7B:
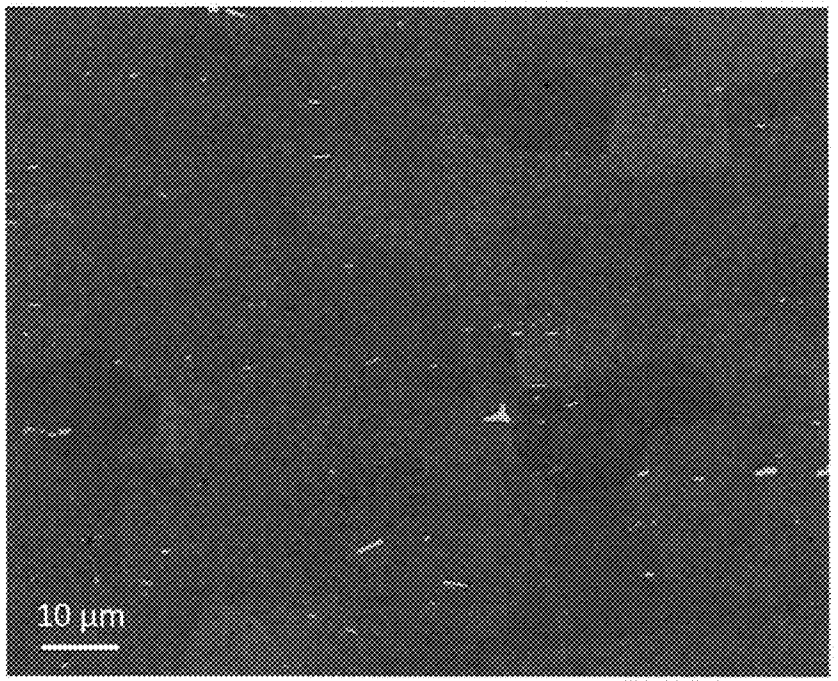
FIG. 7*b* is a micrograph of Alloy 2 of Example 1 in the T4 temper taken in the L-ST plane at the T/4 location.

During their production, samples of Alloy 1 and Alloy 2 were taken at various points of the production process. Specifically, samples of Alloy 1 were taken (1) after hot rolling, (2) after annealing, (3) after cold rolling, and (4) in the T4 temper about 30 days of natural aging). Samples of Alloy 2 were taken (1) after cold rolling and (2) in the T4 temper (about 30 days of natural aging). Micrographs of the samples were then taken at the T/4 location in the L-ST plane. Specifically, a minimum of 10 scanning electron microscope (SEM) micrographs (at 1000× magnification) using backscattered electron imaging (BEI) mode were obtained at the points in the process noted above. Micrographs taken at the T/4 location in the L-ST plane, corresponding to the various points in each process are shown in FIGS. 6*a*-6*d* (Alloy 1) and FIGS. 7*a*-7*b* (Alloy 2).

Next, $Mg_2Si$ particles were detected in the obtained micrographs using a MATLAB® computer script, which detected particles based upon their image contrast. In BEI mode, $Mg_2Si$ particles appear black, while Fe-bearing constituent phases appear white. In this way, a distribution of $Mg_2Si$ particles within the micrographs was assembled, with 1000 to 7000 particles characterized for each processed condition. After detection and characterization, the 2-D sectional diameter of each $Mg_2Si$ particle was determined. Note that the Saltykov correction for converting 2-D diameter to 3-D diameter for convex particles was not applied, as it was not necessary for the characterization. $Mg_2Si$ particle size distributions were then produced using the determined 2-D sectional diameters as the independent variable. $Mg_2Si$ particles having a 2-D sectional diameter of at least 0.50 micron were defined as "coarse" particles, and $Mg_2Si$ particles having a diameter less than 0.50 micron were defined as "fine" particles. The area fraction of fine $Mg_2Si$ particles, coarse $Mg_2Si$ particles, and the total $Mg_2Si$ particle area fraction within 2-D sectional diameter bands (10 per decade) (calculated as a percentage of the total area of the micrograph) were then tabulated. The resultant $Mg_2Si$ particle size distributions were plotted on a semi-log plot, and are shown in FIGS. 8*a*-8*d* (Alloy 1) and FIGS. 9*a*-9*b* (Alloy 2).

Figure 8A:
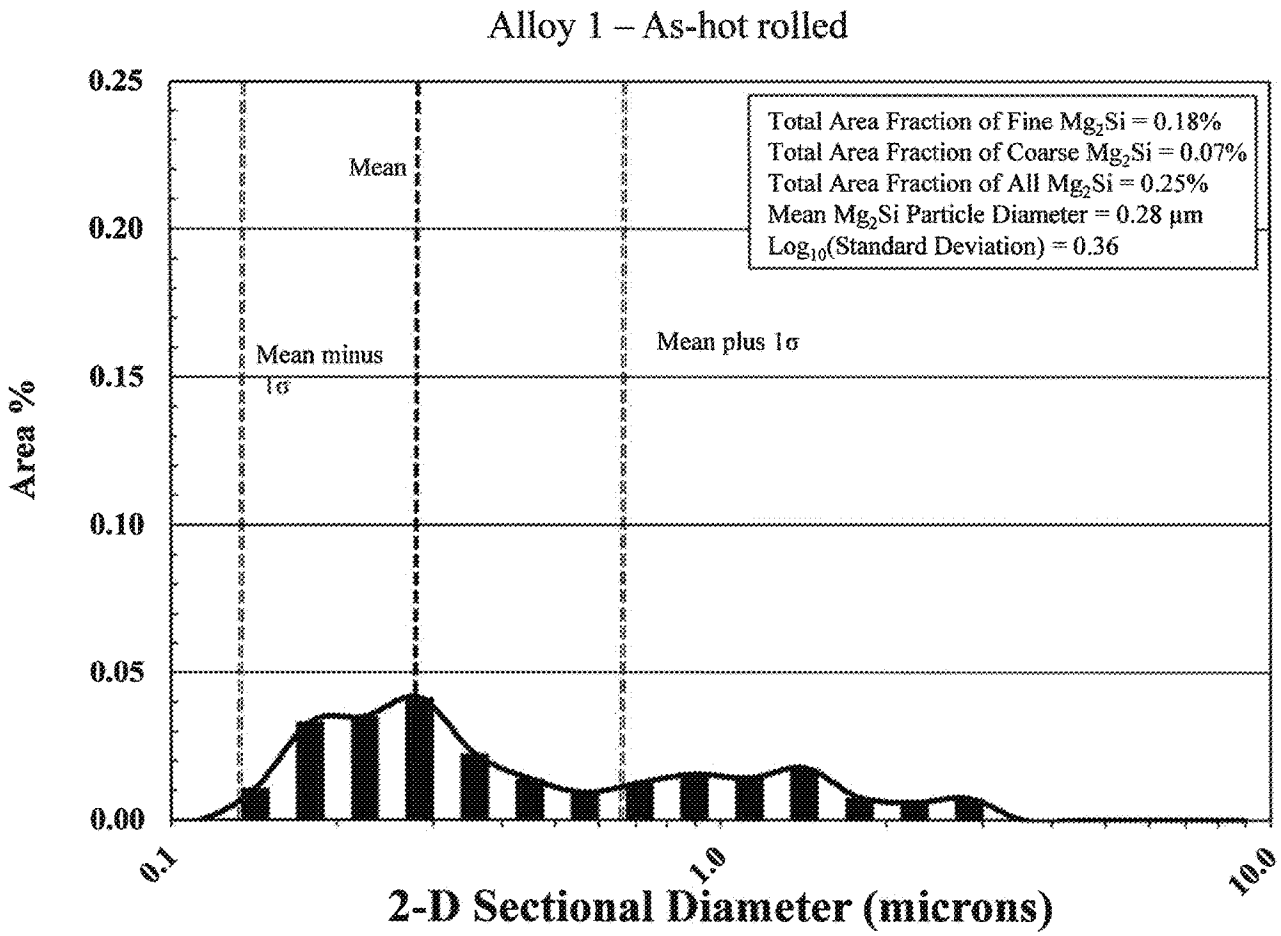
FIG. 8*a* is a $Mg_2Si$ particle size distribution of Alloy 1 of Example 1, in the as-hot rolled condition.

Referring now to FIG. 8*a*, the as-hot rolled specimen of Alloy 1 realized a mean 2-D sectional $Mg_2Si$ particle diameter of 0.28 micron with the log of the standard deviation of the population being 0.36. Of these $Mg_2Si$ particles, 0.18% area fraction are fine $Mg_2Si$ particles and 0.07% area fraction are coarse $Mg_2Si$ particles, yielding a total area fraction of $Mg_2Si$ particles of 0.25%.

Figure 8B:
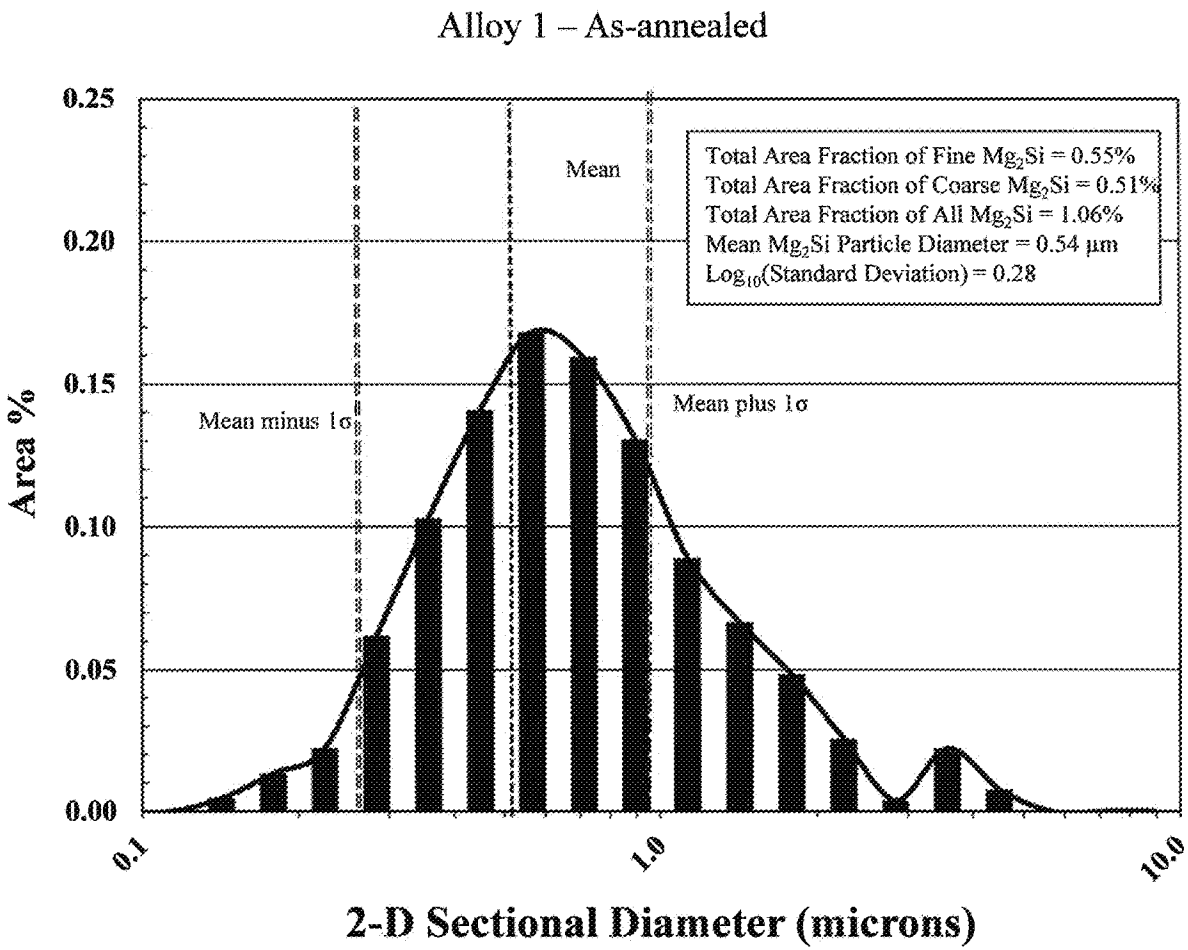
FIG. 8*b* is a $Mg_2Si$ particle size distribution of Alloy 1 of Example 1, in the as-annealed condition.

Referring now to FIG. 8*b*, the as-annealed specimen of Alloy 1 realized a mean 2-D sectional $Mg_2Si$ particle diameter of 0.54 micron with the log of the standard deviation of the population being 0.28. Of these $Mg_2Si$ particles, 0.55% area fraction are fine $Mg_2Si$ particles and 0.51% area fraction are coarse $Mg_2Si$ particles, yielding a total area fraction of $Mg_2Si$ particles of 1.06%. As shown, a anneal at 468° C. (875° F.) increased the area fraction of the $Mg_2Si$ particles by a factor of approximately four, and increased the mean 2-D sectional diameter by a factor of approximately two. Additionally, the area fraction of coarse $Mg_2Si$ particles increased by a factor of approximately seven.

Figure 8C:
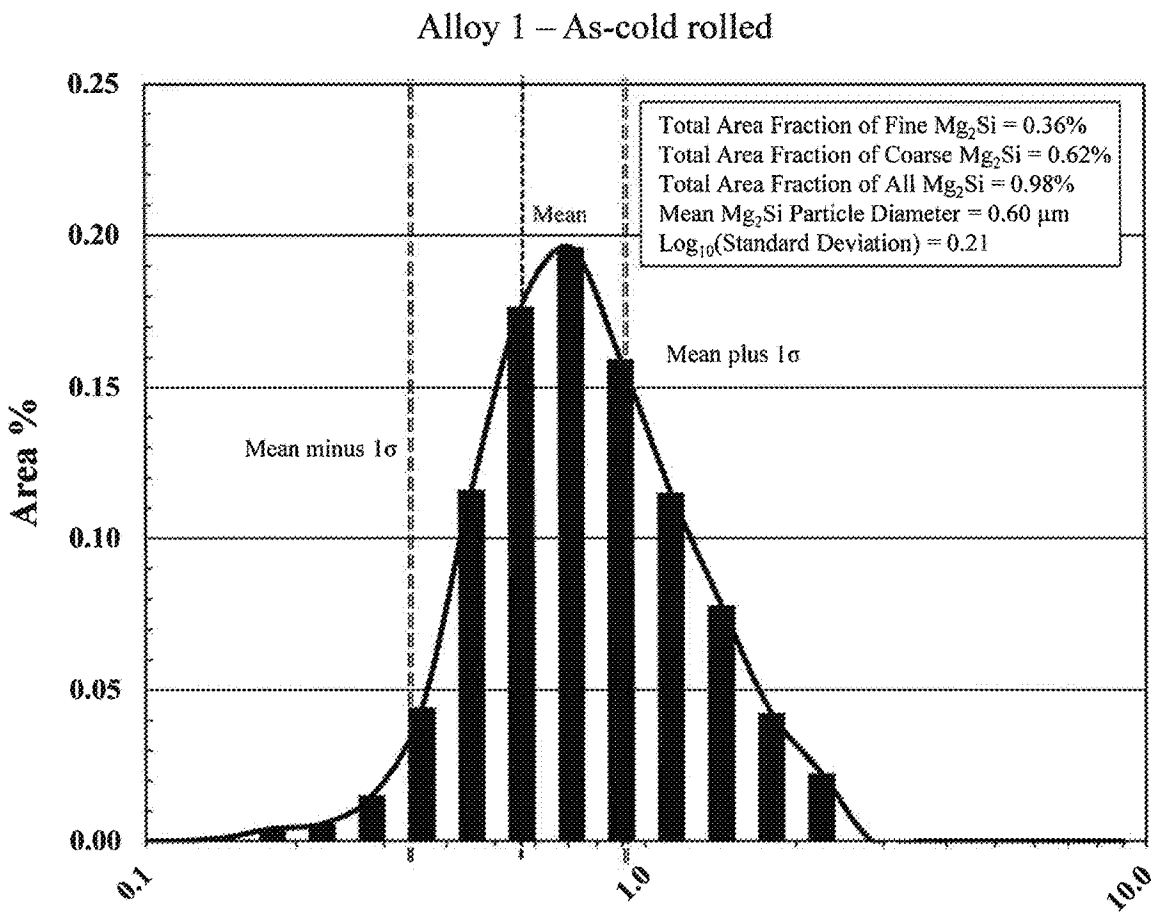
FIG. 8*c* is a $Mg_2Si$ particle size distribution of Alloy 1 of Example 1, in the as-cold rolled condition.

Referring now to FIG. 8*c*, the as-cold rolled specimen of Alloy 1 realized a mean 2-D sectional $Mg_2Si$ particle diameter of 0.60 micron with the log of the standard deviation of the population being 0.21. Of these $Mg_2Si$ particles, 0.36% area fraction are fine $Mg_2Si$ particles and 0.62% area fraction are coarse $Mg_2Si$ particles, yielding a total area fraction of $Mg_2Si$ particles of 0.98%. As shown, cold rolling did not significantly alter either the total area fraction nor the size distribution of the $Mg_2Si$ particles.

Figure 8D:
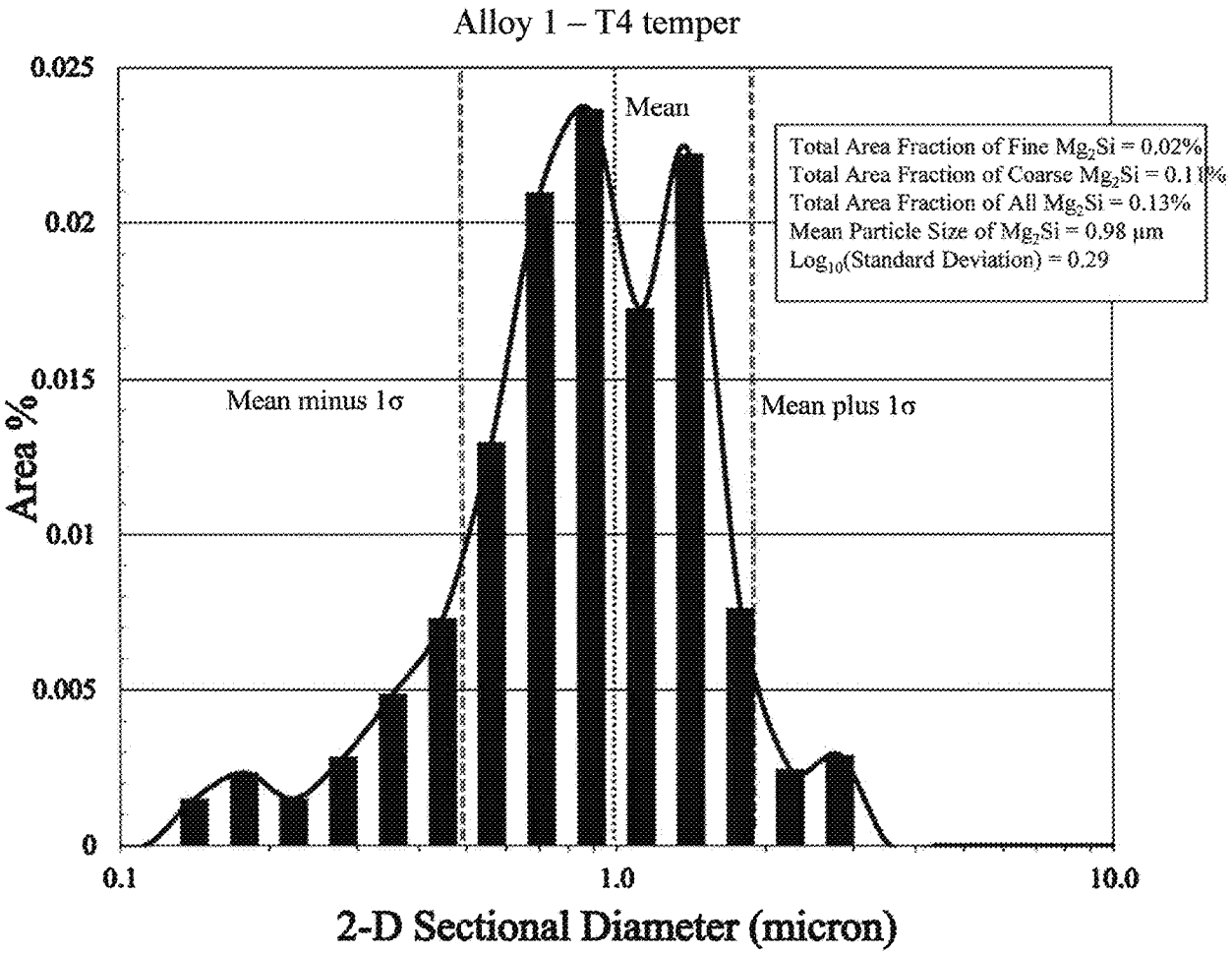
FIG. 8*d* is a $Mg_2Si$ particle size distribution of Alloy 1 of Example 1, in the T4 temper.

Referring now to FIG. 8*d*, the T4 temper specimen of Alloy 1 realized a mean 2-D sectional $Mg_2Si$ particle diameter of 0.98 micron with the log of the standard deviation of the population being 0.21. Of these $Mg_2Si$ particles, 0.02% area fraction are fine $Mg_2Si$ particles and 0.11% area fraction are coarse $Mg_2Si$ particles, yielding a total area fraction of $Mg_2Si$ particles of 0.13%. As shown, the solution heat treatment reduced the total area fraction of $Mg_2Si$ particles by approximately 90% (from 0.98% to 0.13%). Also, the mean 2-D sectional diameter of the remnant $Mg_2Si$ particles increased by a factor of at least 1.5 from the as-cold rolled condition. It is believed this is due to the kinetics of solutionization favoring a greater proportional loss of fine particles, as the larger particles are more resistant to dissolution.

Figure 9A:
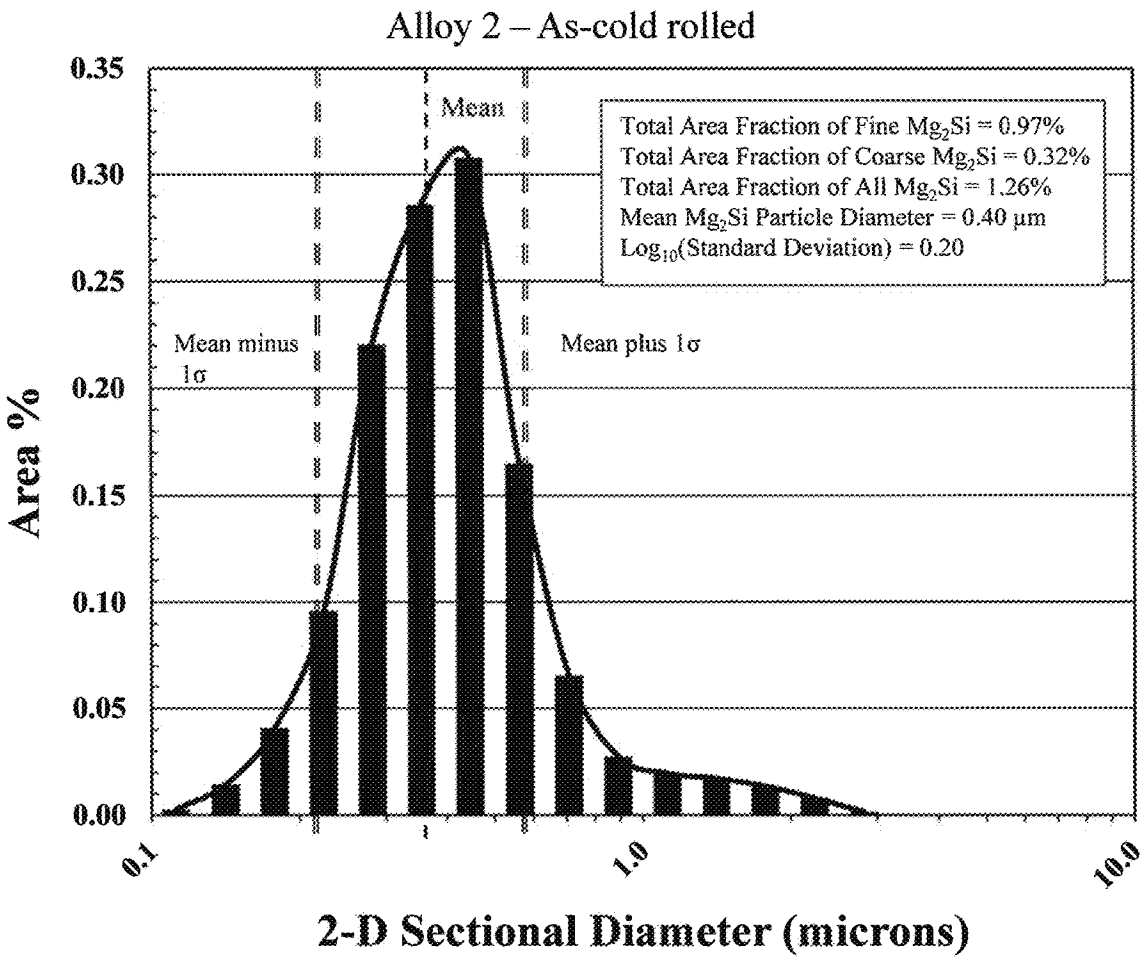
FIG. 9*a* is a $Mg_2Si$ particle size distribution of Alloy 2 of Example 1, in the as-cold rolled condition.

Referring now to FIG. 9*a*, the as-cold rolled specimen of Alloy 2 realized a mean 2-D sectional $Mg_2Si$ particle diameter of 0.40 micron with the log of the standard deviation of the population being 0.20. Of these $Mg_2Si$ particles, 0.97% area fraction are fine $Mg_2Si$ particles and 0.32% area fraction are coarse $Mg_2Si$ particles, yielding a total area fraction of $Mg_2Si$ particles of 1.26%.

Figure 9B:
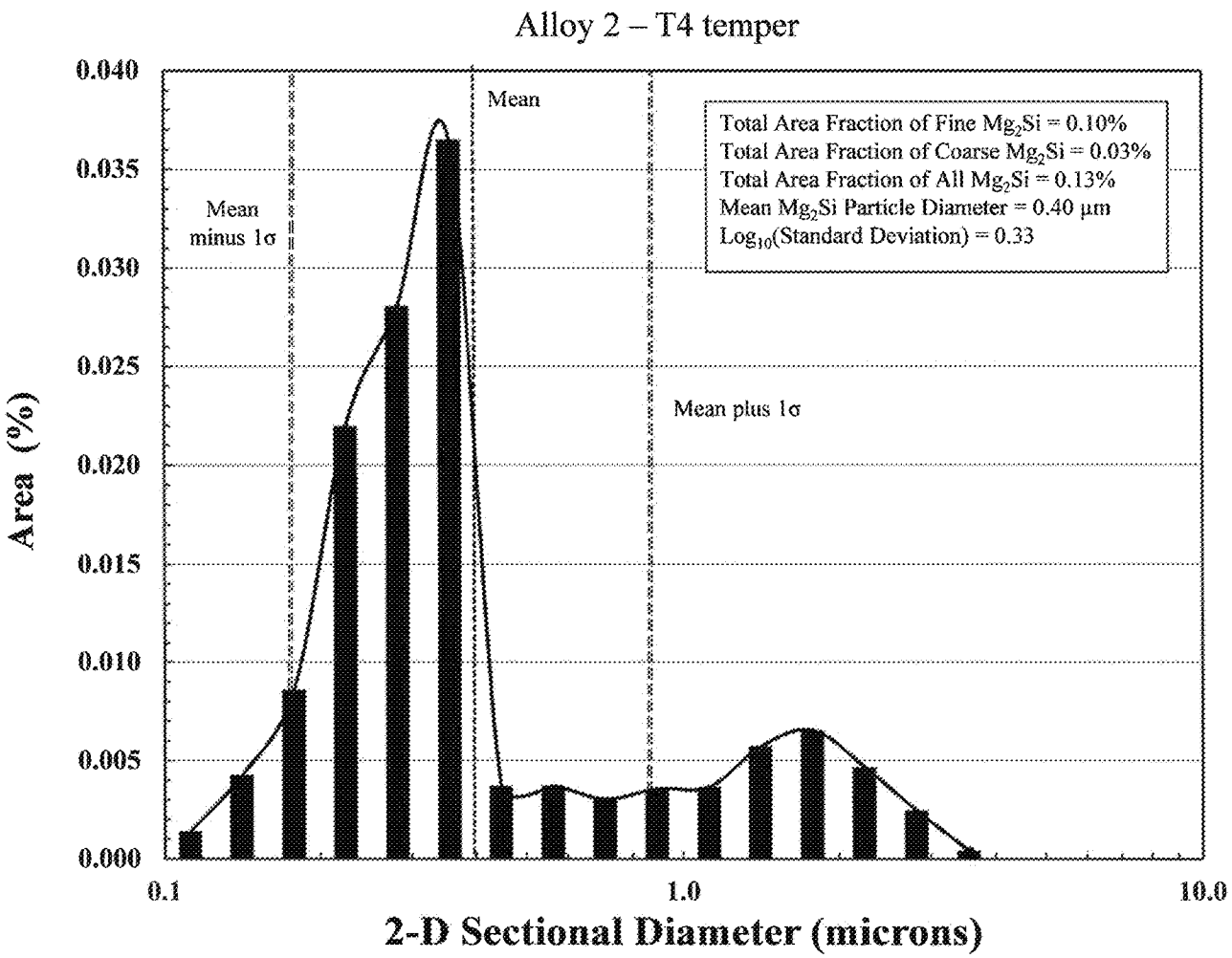
FIG. 9*b* is a $Mg_2Si$ particle size distribution of Alloy 2 of Example 1, in the T4 temper.

Referring now to FIG. 9*b*, the T4 temper specimen of Alloy 2 realized a mean 2-D sectional $Mg_2Si$ particle diameter of 0.40 micron with the log of the standard deviation of the population being 0.33. Of these $Mg_2Si$ particles, 0.10% area fraction are fine $Mg_2Si$ particles and 0.03% area fraction are coarse $Mg_2Si$ particles, yielding a total area fraction of $Mg_2Si$ particles of 0.13%. As with Alloy 1, the solutionization treatment reduced the total area fraction of solute to 0.13% area fraction. The $Mg_2Si$ particle distribution in the as-rolled specimen was different, however, and the remnant $Mg_2Si$ particle distribution was different as well.

FIG. 10 summarizes some of the obtained data. As shown in FIG. 10, the area fraction of coarse $Mg_2Si$ particles in the as-cold rolled specimen is 0.62% for Alloy 1 and 0.32% for Alloy 2. Additionally, the area fraction of fine $Mg_2Si$ particles in the as-cold rolled specimen is 0.36% for Alloy 1 and 0.97% for Alloy 2. In the T4 temper, the total area fraction of all $Mg_2Si$ particles is the same for Alloy 1 and Alloy 2 at 0.13%. The area fraction of coarse $Mg_2Si$ particles in the T4 temper is 0.11% for Alloy 1 and 0.03% for Alloy 2. Additionally, the area fraction of fine $Mg_2Si$ particles in the T4 temper is 0.02% for Alloy 1 and 0.10% for Alloy 2. In addition to these differences in $Mg_2Si$ particle distributions, the mean diameter in the as-cold rolled specimen is 0.60 micron for Alloy 1 and 0.40 micron for Alloy 2. Furthermore, the mean diameter in the T4 temper is 0.98 micron for Alloy 1 and 0.40 micron for Alloy 2. Thus, relative to the non-inventive alloy (Alloy 2), the inventive alloy (Alloy 1) realizes a lower area fraction of fine $Mg_2Si$ particles, a greater area fraction of coarse particles, and a greater mean diameter in both the as-cold rolled condition and T4 temper, which will remain largely unchanged even in the T6 (artificially aged) temper. As shown below, the invention alloy realized significant improvement in automotive sheet performance due to these $Mg_2Si$ particle differences: improved long term strength stability and improved hemming response, as compared to the non-invention alloy.

Evaluation of Tensile Properties

Figure 11:
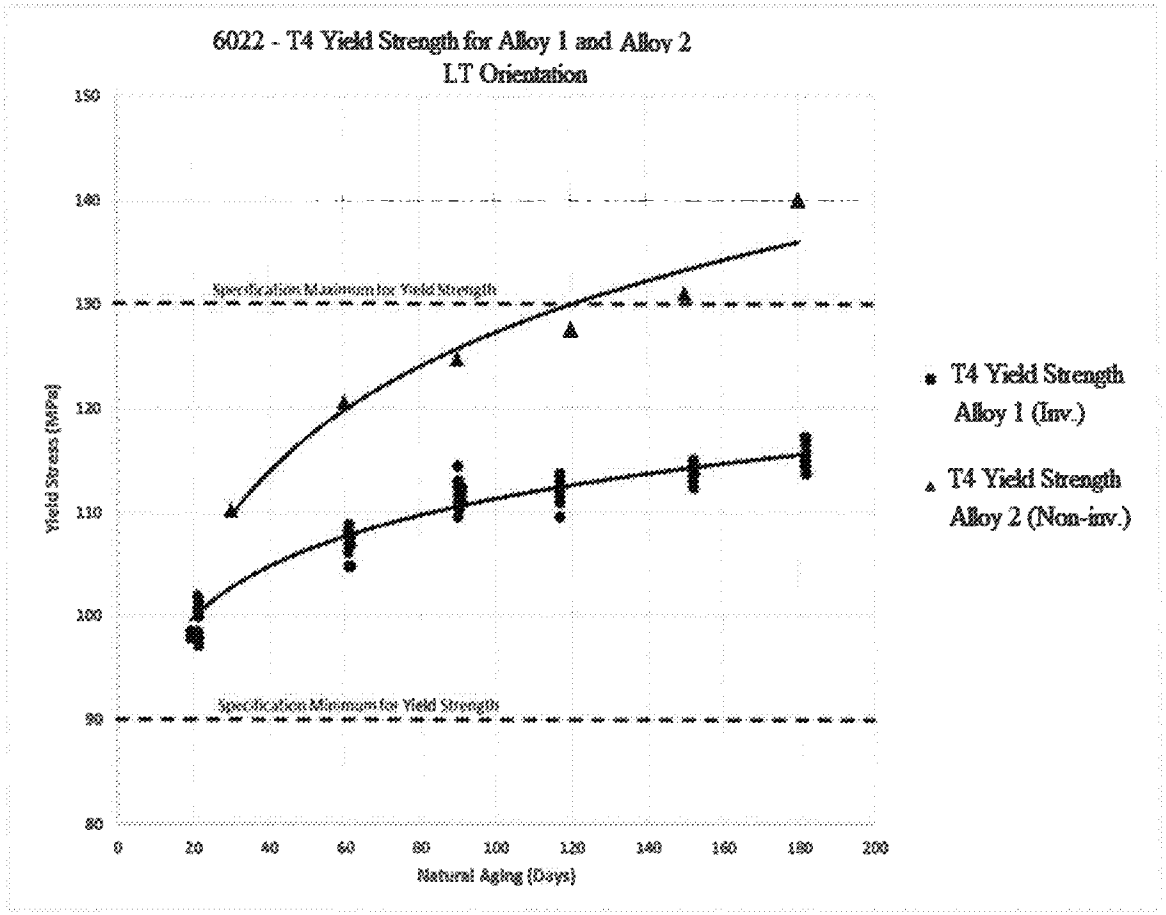
FIG. 11 is a plot showing the tensile yield strength taken in the long transverse direction during a natural aging period of 180 days, for Alloys 1 and 2 of Example 1.

Tensile yield strength was measured for naturally aged samples of Alloy 1. Specifically, the tensile yield strength of Alloy 1 was evaluated at 20, 60, 90, 115, 155, and 180 days. Tensile yield strength measurements were performed in the long transverse direction per ASTM E8 and ASTM B557, the results of which are shown in FIG. 11. For comparison, the tensile yield strength with respect to aging time is also shown for Alloy 2 in FIG. 11. As shown in FIG. 11, the natural aged yield strength of Alloy 1 is more stable than the non-inventive alloy, Alloy 2. Additionally, Alloy 1 stays within a yield strength product specification range of 90 MPa to 130 MPa for at least 200 days of natural aging, and in accordance with an automotive supply specification, while the conventional alloy exceeds the yield strength product specification at about 120 days of natural aging. As most automotive manufactures require product specifications out to 180 days, this increased stability is of significant economic impact, as it increases recovery and reduces the scrapping of aluminum sheet due to excessive natural aging, which can compromise stamping and hemming performance.

Evaluation of Hemming Performance

Figure 12:
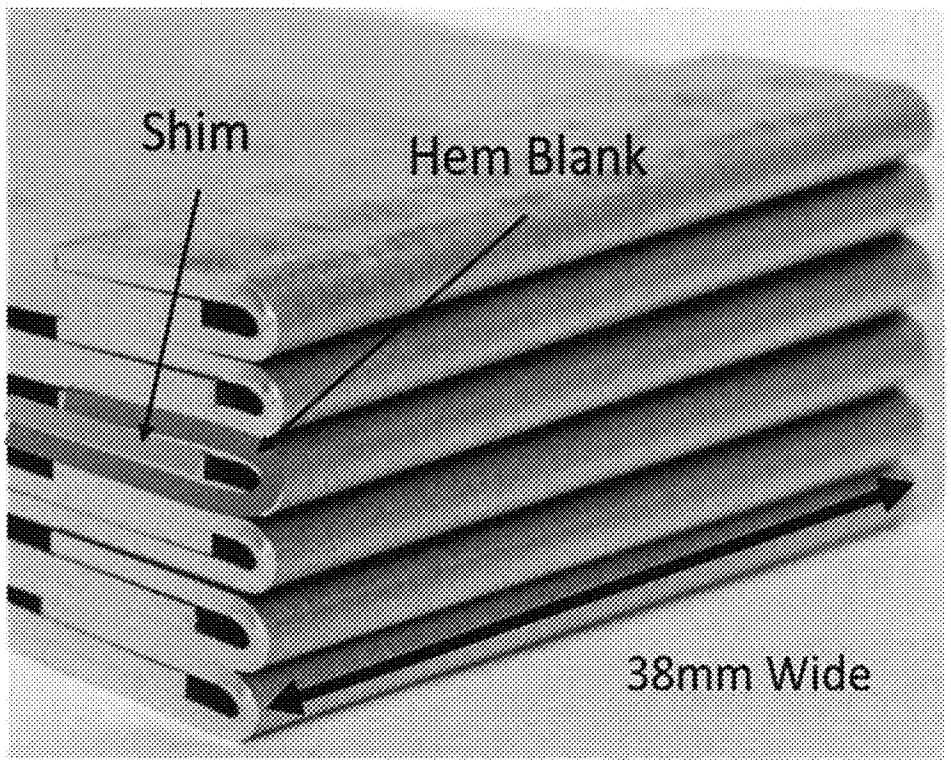
FIG. 12 is an example of hemmed aluminum alloy sheet samples demonstrating the technique used in evaluating the hemming performance of Alloys 1 and 2 in Example 1.

Hemming is a common practice in the automotive industry, where an aluminum sheet functioning as the outer panel of a vehicle component (e.g., a hood or door) is physically wrapped around (e.g., hemmed) an inner panel of a vehicle component (e.g., again, a hood or door). This construction increases the rigidity of the component as well as providing a water-tight seal preventing the ingress of moisture. Such hem seams are also aesthetic, as a smooth, flat hem, free of surface defects, is demanded by automotive customers. Therefore, the performance of aluminum alloys in hems is important to some sheet products used in the automotive industry. In this regard, hemming samples of Alloy 1 were cut to 127 mm (5 inches) in length, naturally aged, and then tested for hemming performance. As the hemming operation follows stamping, it is conventional to impose a strain on the samples prior to the actual hemming (to simulate the strain of stamping). In these tests, samples were stretched to a pre-strain of 14% and then wrapped around a shim of the same material, and at the same gauge (simulating the inner panel), at approximately 180°, as shown in FIG. 12. This is referred to as a 1-T flat hem, and is a standard test in the automotive industry.

The quality of a flat hem is based upon its appearance. FIG. 13 shows a standard scale use by one automotive manufacturer, where the hem is rated on a scale of 1 to 5, based on its susceptibility to deleterious surface defects (e.g., roughness; severity of micro-cracking on the surface, etc.). Experience has shown that such hemming performance degrades with natural aging, with hemmed aluminum alloy sheet showing greater susceptibility to cracking with increasing natural aging times. Failure to provide high quality hems (ratings of 1 to 3) is a common cause of sheet rejection by automotive manufacturers.

Figure 14:
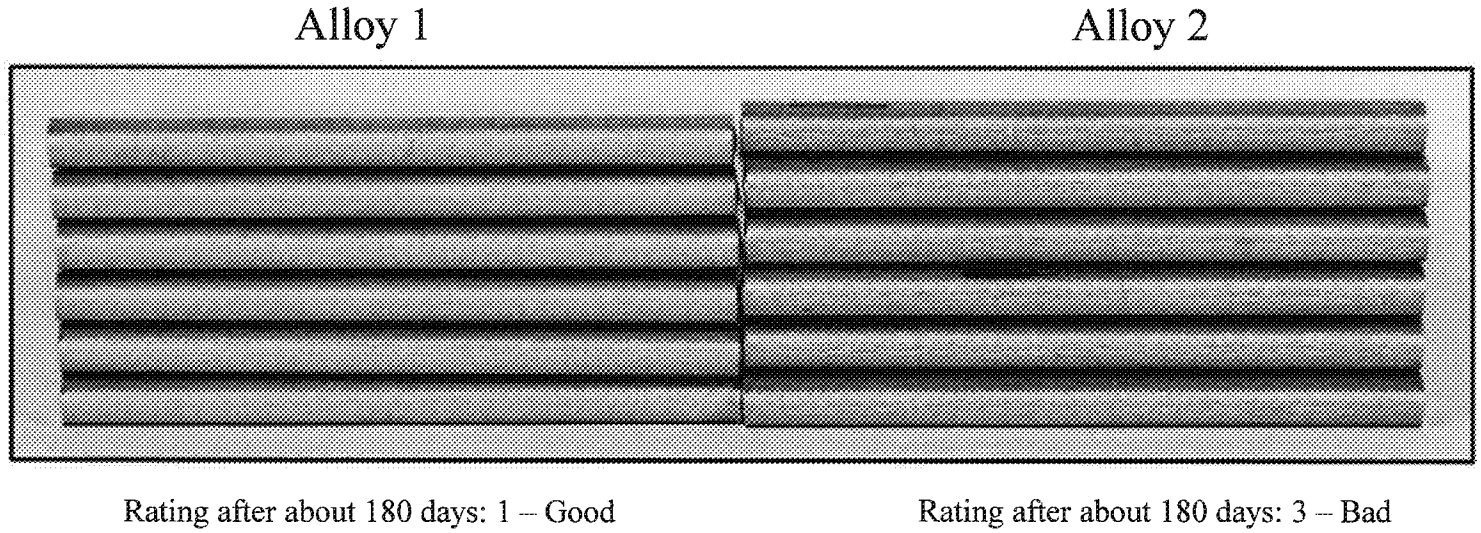
FIG. 14 is a photograph of hemmed samples of Alloy 1 and Alloy 2, at a pre-strain of 14%, after about 180 days of natural aging.

Hemming samples of Alloy 1 at about 180 days of natural aging and at a pre-strain of 14% are shown in FIG. 14. For comparison, hemming samples of Alloy 2 are also shown in FIG. 14. After 180 days of natural aging and at a pre-strain of 14%, Alloy 1 realized a rating of 1 ("Good"), while Alloy 2 realized a rating of 3 ("Bad").

While not being bound by any theory, it is believed the anneal conditions used for Alloy 1 produced coarser $Mg_2Si$ particles and thus decreased the rate of natural aging as shown by the change of tensile properties and the hemming evaluation. In general, natural aging may occur when strengthening precipitates (e.g., GPB zones or the precursors to (3" ($Mg_5Si_6$) in aluminum alloy 6022) are formed during the natural aging period. As illustrated above, the area fraction of coarse particles in Alloy 1 is greater than that of Alloy 2 in the T4 temper. Therefore, the total dissolved solute after solution heat treatment for Alloy 1 may be lower, thereby reducing the rate of natural aging. Furthermore, the higher area fraction of coarse $Mg_2Si$ particles in Alloy 1 may promote a metallurgical transformation known as particle stimulated nucleation. The $Mg_2Si$ particles, which are resistant to deformation during cold rolling, may induce regions of turbulence in the aluminum matrix, which must then conform to accommodate the $Mg_2Si$ particles. Cold rolling may produce strained, dislocation-rich regions that may act as sites for grain nucleation during the subsequent solution heat treatment and recrystallization. The nucleation sites may promote the formation of new grains with crystallographic orientations that may differ from that of other grains in the product. Therefore, the $Mg_2Si$ particles may introduce greater randomization in the crystallographic texture, which may improve the isotropy of the material.

What is claimed is:

1. A method comprising:

(a) preparing a 6xxx aluminum alloy sheet for precipitate phase modification, wherein the preparing comprises:

(i) hot rolling a 6xxx aluminum alloy to an intermediate gauge strip;

(A) wherein the intermediate gauge strip comprises an initial precipitate phase particle size distribution comprising fine precipitate phase particles and coarse precipitate phase particles;

(b) modifying the initial precipitate phase particle size distribution of the intermediate gauge strip, wherein the modifying comprises:

(i) heating the intermediate gauge strip to a temperature of from 440° C. (825° F.) to 500° C. (932° F.) for a time sufficient to create a modified strip product having a modified precipitate phase particle size distribution, wherein:

(A) the total area fraction of the modified precipitate phase particle size distribution is at least twice that of the initial total area fraction of the initial precipitate phase particle size distribution;

(B) the modified particle size distribution comprises a mean sectional diameter of at least 0.3 micron;

(C) the modified strip product comprises at least one-third (33%) coarse precipitate phase particles; and (D) the modified strip product comprises at least 5% of fine precipitate phase particles.

2. The method of claim 1, wherein the heating step (b)(i) occurs for a time of at least 0.5 hours.

3. The method of claim 2, wherein the heating step (b)(i) occurs for a time of not greater than 8 hours.

4. The method of claim 3, wherein the heating step (b)(i) occurs at a temperature of from 450° C. (842° F.) to 470° C. (878° F.).

5. The method of claim 4, wherein the heating step (b)(i) occurs for a time of from 1 hour to 5 hours.

6. The method of claim 5, wherein the modified particle size distribution comprises a mean sectional diameter of not greater than 1.0 micron.

7. The method of claim 3, comprising:

after the modifying step (b), cold rolling the intermediate gauge strip to a final gauge sheet.

8. The method of claim 7, comprising:

after the cold rolling step, solution heat treating and then quenching the final gauge sheet, thereby producing a tempered 6xxx aluminum alloy sheet product.

9. The method of claim 8, wherein, due to the modifying step (b), the tempered 6xxx aluminum alloy sheet product realizes (i) a first tensile yield strength at 20 days of natural aging, (ii) a second tensile yield strength at 180 days of natural aging, and (iii) a ratio of the second tensile yield strength to the first tensile yield strength of not greater than 1.25:1.

10. The method of claim 8, wherein the tempered 6xxx aluminum alloy sheet product realizes a tempered precipitate phase particle size distribution, and wherein at least 33% of the precipitate phase particles are coarse particles.

11. The method of claim 10, wherein at least 50% of the precipitate phase particles are coarse particles.

12. The method of claim 10, wherein at least 70% of the precipitate phase particles are coarse particles.

13. The method of claim 10, wherein the tempered precipitate phase particle size distribution realizes a mean 2-D sectional diameter of from 0.5 to 2.0 microns.

14. The method of claim 13, wherein the tempered precipitate phase particle size distribution comprises a tempered area fraction of coarse particles, and wherein the tempered area fraction of coarse particles is at least 0.04%, and wherein the mean 2-D sectional diameter is at least 0.7 micron.

* * * * *